US008500546B2

(12) United States Patent
Walker et al.

(10) Patent No.: US 8,500,546 B2
(45) Date of Patent: Aug. 6, 2013

(54) METHOD AND APPARATUS FOR DIRECTING A GAME IN ACCORDANCE WITH SPEED OF PLAY

(75) Inventors: Jay S. Walker, Ridgefield, CT (US); James A. Jorasch, Stamford, CT (US); Thomas M. Sparico, Hoboken, NJ (US); Geoffrey M. Gelman, Stamford, CT (US)

(73) Assignee: IGT, Reno, NV (US)

( * ) Notice: Subject to any disclaimer, the term of this patent is extended or adjusted under 35 U.S.C. 154(b) by 894 days.

(21) Appl. No.: 11/428,419

(22) Filed: Jul. 3, 2006

(65) Prior Publication Data

US 2007/0004508 A1 Jan. 4, 2007

Related U.S. Application Data

(63) Continuation of application No. 10/770,231, filed on Feb. 2, 2004, now abandoned.

(51) Int. Cl.
*A63F 9/24* (2006.01)

(52) U.S. Cl.
USPC ..... 463/23; 463/16; 463/20; 463/25; 273/138.1; 273/139

(58) Field of Classification Search
USPC ..... 463/16, 20–23, 25, 26, 40–43, 46, 463/47; 273/138.1, 139, 141 A, 141 R, 143 A, 273/143 R
See application file for complete search history.

(56) References Cited

U.S. PATENT DOCUMENTS 4,238,127 A 12/1980 Lucero et al. ..... 273/143 R
4,299,388 A 11/1981 Resch et al. ..... 273/143 R (Continued)

FOREIGN PATENT DOCUMENTS

DE 2844124 A 4/1980
DE 3830648 A 3/1990

(Continued)

OTHER PUBLICATIONS

Kent, Bill, "Atlantic City; The Slot With Something Extra", The New York Times, Oct. 29, 1995, Section 13NJ; p. 16, col. 3, New Jersey Weekly Desk, 2pp.

(Continued)

*Primary Examiner* — David L Lewis
*Assistant Examiner* — Chase Leichliter
(74) *Attorney, Agent, or Firm* — Neal, Gerber & Eisenberg LLP

(57) ABSTRACT

In accordance with the present invention, a gaming device such as a slot machine calculates a speed of game play, and in turn determines a pay schedule based on the speed of game play. The pay schedule for higher speeds of game play typically provides a higher payout percentage, which attracts players and provides an incentive to play faster and for longer periods of time. The greater speed of play and time period of playing may actually increase revenues derived from the gaming device even though the payout percentage is higher. Speed of game play may be calculated by measuring the number of games played in a predetermined time period, or the time elapsed between games. The gaming device may select a payout table from a plurality of payout tables based on this speed. Alternatively, the gaming device may determine a multiplier based on the speed of game play, and adjust a base payout table in accordance with the multiplier.

18 Claims, 18 Drawing Sheets

(56) References Cited

U.S. PATENT DOCUMENTS

| | | | | |
|---|---|---|---|---|
| 4,353,554 | A | 10/1982 | Fisher | 273/143 R |
| 4,373,727 | A | 2/1983 | Hooker et al. | 273/143 R |
| 4,430,903 | A | 2/1984 | Hooker et al. | 74/153 |
| 4,479,081 | A | 10/1984 | Harris | 318/696 |
| 4,575,085 | A | 3/1986 | Ollington | 273/138 R |
| 4,593,904 | A | 6/1986 | Graves | 273/1 E |
| 4,661,906 | A | 4/1987 | DiFrancesco et al. | 364/410 |
| 4,676,506 | A | 6/1987 | Crouch | 273/143 R |
| 4,679,143 | A | 7/1987 | Hagiwara | 364/412 |
| 4,770,415 | A | 9/1988 | Evans et al. | 273/1 E |
| 4,964,638 | A | 10/1990 | Ishida | |
| 4,991,848 | A | 2/1991 | Greenwood et al. | 273/143 R |
| 5,024,439 | A | 6/1991 | Okada | 273/143 R |
| 5,033,744 | A | 7/1991 | Bridgeman et al. | 273/85 CP |
| 5,072,381 | A | 12/1991 | Richardson et al. | 364/410 |
| 5,116,055 | A | 5/1992 | Tracy | |
| 5,123,649 | A | 6/1992 | Tiberio | 273/143 R |
| 5,127,651 | A | 7/1992 | Okada | |
| 5,154,420 | A | 10/1992 | Gutknecht | 273/138 A |
| 5,178,395 | A | 1/1993 | Lovell | 273/238 |
| 5,224,706 | A | 7/1993 | Bridgeman et al. | 273/85 CP |
| 5,277,424 | A | 1/1994 | Wilms | 273/85 CP |
| 5,297,802 | A | 3/1994 | Pocock et al. | 273/439 |
| 5,370,399 | A * | 12/1994 | Liverance | 463/23 |
| 5,393,057 | A | 2/1995 | Marnell, II | |
| 5,393,061 | A | 2/1995 | Manship et al. | |
| 5,398,938 | A | 3/1995 | Money | |
| 5,423,541 | A | 6/1995 | Nicastro et al. | 273/143 R |
| 5,456,465 | A | 10/1995 | Durham | 273/138 A |
| 5,470,079 | A | 11/1995 | LeStrange et al. | 273/138 A |
| 5,472,197 | A | 12/1995 | Gwiasda et al. | 273/143 R |
| 5,494,295 | A | 2/1996 | Potter et al. | 273/292 |
| 5,516,293 | A | 5/1996 | Heidel et al. | 453/32 |
| 5,518,253 | A | 5/1996 | Pocock et al. | 273/439 |
| 5,542,669 | A | 8/1996 | Charron et al. | 463/13 |
| 5,560,603 | A | 10/1996 | Seelig et al. | |
| 5,569,084 | A | 10/1996 | Nicastro et al. | 463/20 |
| 5,613,912 | A | 3/1997 | Slater | 463/25 |
| 5,655,961 | A | 8/1997 | Acres et al. | |
| 5,664,998 | A | 9/1997 | Seelig et al. | |
| 5,683,295 | A | 11/1997 | Frain | 463/19 |
| 5,697,483 | A | 12/1997 | Ishida et al. | 194/217 |
| 5,697,614 | A | 12/1997 | Potter et al. | 273/292 |
| 5,697,843 | A | 12/1997 | Manship et al. | 463/20 |
| 5,752,881 | A | 5/1998 | Inoue | 463/20 |
| 5,770,533 | A | 6/1998 | Franchi | |
| 5,779,544 | A | 7/1998 | Seelig et al. | |
| 5,782,470 | A | 7/1998 | Langan | 273/139 |
| 5,833,536 | A | 11/1998 | Davids et al. | 463/11 |
| 5,839,957 | A | 11/1998 | Schneider et al. | 463/20 |
| 5,845,902 | A | 12/1998 | Takemoto | |
| 5,976,015 | A | 11/1999 | Seelig et al. | |
| 5,988,499 | A | 11/1999 | Sisca | 235/419 |
| 5,997,400 | A | 12/1999 | Seelig et al. | |
| 6,012,982 | A | 1/2000 | Piechowiak et al. | |
| 6,012,983 | A | 1/2000 | Walker et al. | 463/20 |
| 6,015,344 | A | 1/2000 | Kelly et al. | 463/16 |
| 6,033,306 | A | 3/2000 | De Souza | 463/18 |
| 6,077,163 | A | 6/2000 | Walker et al. | 463/26 |
| 6,110,041 | A | 8/2000 | Walker et al. | 463/20 |
| 6,183,366 | B1 * | 2/2001 | Goldberg et al. | 463/42 |
| 6,238,288 | B1 | 5/2001 | Walker et al. | 463/26 |
| 6,244,957 | B1 | 6/2001 | Walker et al. | 463/20 |
| 6,254,483 | B1 * | 7/2001 | Acres | 463/26 |
| 6,287,201 | B1 * | 9/2001 | Hightower | 463/41 |
| 6,293,866 | B1 | 9/2001 | Walker et al. | 463/20 |
| 6,319,125 | B1 | 11/2001 | Acres | 463/25 |
| 6,612,927 | B1 | 9/2003 | Slomiany et al. | |
| 6,692,355 | B2 | 2/2004 | Baerlocher et al. | |
| 6,695,700 | B2 | 2/2004 | Walker et al. | |
| 6,702,674 | B1 | 3/2004 | De Bruin et al. | |
| 6,722,976 | B2 | 4/2004 | Adams | |
| 6,764,397 | B1 * | 7/2004 | Robb | 463/23 |
| 7,033,276 | B2 * | 4/2006 | Walker et al. | 463/40 |
| 7,314,411 | B2 | 1/2008 | Lannert et al. | |
| 7,846,018 | B2 * | 12/2010 | Baerlocher | 463/20 |
| 8,002,621 | B2 * | 8/2011 | Mattice et al. | 463/16 |
| 2002/0132658 | A1 | 9/2002 | Brown et al. | |
| 2004/0017041 | A1 | 1/2004 | Inoue | |
| 2009/0170588 | A1 * | 7/2009 | Baerlocher | 463/20 |
| 2010/0056241 | A1 * | 3/2010 | Acres | 463/13 |

FOREIGN PATENT DOCUMENTS

| | | | |
|---|---|---|---|
| DE | 4126287 | A | 2/1993 |
| JP | 07-308439 | A | 11/1995 |
| JP | 09-173630 | A | 7/1997 |
| WO | WO 01/10523 | | 2/2001 |

OTHER PUBLICATIONS

Briscoe, James, "Urban Renewal", Casino Spain, Jun. 1997, p. 42, 1pg.

JP 07-308439A and English translation of paragraph [0027] of same submitted with Third Party Submission in Published Application Under 37 C.F.R. 1.99 for U.S. Appl. No. 13/212,618 (3 pages).

JP 09-173630A and English translation of paragraph [0017] of same submitted with Third Party Submission in Published Application Under 37 C.F.R. 1.99 for U.S. Appl. No. 13/212,618 (3 pages).

Office Action for U.S. Appl. No. 13/212,618 dated Jun. 15, 2012 (17 pages).

Office Action for U.S. Appl. No. 13/197,501 dated May 17, 2012 (21 pages).

Letter from Marvin A. Motsenbocker of Mots Law dated Feb. 14, 2012 regarding Third Party Submission in Published Application Under 37 C.F.R. 1.99 filed for U.S. Appl. No. 13/212,618 (1 page).

Third Party Submission in Published Application Under 37 C.F.R. 1.99 filed for U.S. Appl. No. 13/212,618, dated Feb. 14, 2012 (3 pages).

JP 07-308439A and English translation of paragraph [0027] of same submitted with Third Party Submission in Published Application Under 37 C.F.R. 1.99 for U.S. Appl. No. 13/212,618 (3 pages), Feb. 2012.

JP 09-173630A and English translation of paragraph [0017] of same submitted with Third Party Submission in Published Application Under 37 C.F.R. 1.99 for U.S. Appl. No. 13/212,618 (3 pages), Feb. 2012.

Office Action for Application No. 101790 167 dated Oct. 9, 2007.

Office Action for Application No. 101790 167 dated Apr. 2, 2008.

Notice of Allowance for Application No. 101790 167 dated Oct. 6, 2008.

Office Action for U.S. Appl. No. 09/001,902 dated Sep. 30, 1999.

Office Action for U.S. Appl. No. 09/001,902 dated Jan. 6, 2000.

Office Action for U.S. Appl. No. 09/001,902 dated 0711 7/00.

Notice of Allowance for U.S. Appl. No. 09/001,902 dated Nov. 14, 2000.

Office Action for Application No. 09178325 1 dated Oct. 23, 2002.

Notice of Allowance for Application No. 09178325 1 dated Sep. 23, 2003.

Office Action for Application No. 10177023 1 dated Jan. 9, 2008.

Office Action for Application No. 10177023 1 dated Jul. 24, 2008.

Office Action for Application No. 1 114284 13 dated Oct. 9, 2007.

Office Action for Application No. 1 114284 13 dated Sep. 9, 2008.

* cited by examiner

30

| OUTCOME DESCRIPTION 100 | NUMBER OF ARRANGEMENTS OF ELEMENTS 102 | PROBABILITY 104 | RANDOM NUMBER RANGE 106 |
|---|---|---|---|
| NONWINNING COMBINATION | 8570 | 80.48% | 1-8570 |
| CHERRY/ANY/ANY | 680 | 6.386% | 8571-9250 |
| ANY/ANY/CHERRY | 680 | 6.386% | 9251-9930 |
| CHERRY/CHERRY/ANY | 200 | 1.878% | 9931-10130 |
| ANY/CHERRY/CHERRY | 200 | 1.878% | 10131-10330 |
| CHERRY/ANY/CHERRY | 68 | 0.639% | 10331-10398 |
| CHERRY/CHERRY/CHERRY | 20 | 0.188% | 10399-10418 |
| BAR/ORANGE/ORANGE | 42 | 0.394% | 10419-10460 |
| ORANGE/ORANGE/BAR | 6 | 0.056% | 10461-10466 |
| 110 → ORANGE/ORANGE/ORANGE | 42 | 0.394% | 10467-10508 |
| BAR/PLUM/PLUM | 20 | 0.188% | 10508-10528 |
| PLUM/PLUM/BAR | 5 | 0.047% | 10529-10533 |
| PLUM/PLUM/PLUM | 50 | 0.470% | 10534-10583 |
| 112 → BAR/BELL/BELL | 4 | 0.038% | 10584-10587 |
| BELL/BELL/BAR | 20 | 0.188% | 10588-10607 |
| BELL/BELL/BELL | 20 | 0.188% | 10608-10627 |
| BAR/BAR/BAR | 20 | 0.188% | 10628-10647 |
| 7/7/7 | 1 | 0.009% | 10648 |

FIG. 4

120

| OUTCOME DESCRIPTION 122 | PAYOUT 124 | PROBABILITY 126 | EXPECTED PAYOUT 128 |
|---|---|---|---|
| NONWINNING COMBINATION | 0 | 80.48% | 0 |
| CHERRY/ANY/ANY | 2 | 6.386% | 0.128 |
| ANY/ANY/CHERRY | 2 | 6.386% | 0.128 |
| CHERRY/CHERRY/ANY | 5 | 1.878% | 0.094 |
| ANY/CHERRY/CHERRY | 5 | 1.878% | 0.094 |
| CHERRY/ANY/CHERRY | 5 | 0.639% | 0.032 |
| CHERRY/CHERRY/CHERRY | 20 | 0.188% | 0.038 |
| BAR/ORANGE/ORANGE | 14 | 0.394% | 0.055 |
| ORANGE/ORANGE/BAR | 14 | 0.056% | 0.008 |
| ORANGE/ORANGE/ORANGE | 20 | 0.394% | 0.079 |
| BAR/PLUM/PLUM | 10 | 0.188% | 0.019 |
| PLUM/PLUM/BAR | 10 | 0.047% | 0.005 |
| PLUM/PLUM/PLUM | 20 | 0.470% | 0.094 |
| BAR/BELL/BELL | 18 | 0.038% | 0.007 |
| BELL/BELL/BAR | 18 | 0.188% | 0.034 |
| BELL/BELL/BELL | 20 | 0.188% | 0.038 |
| BAR/BAR/BAR | 50 | 0.188% | 0.094 |
| 7/7/7 | 100 | 0.009% | 0.009 |

FIG. 5

200

| OUTCOME DESCRIPTION | PAYOUT | EXPECTED PAYOUT |
|---|---|---|
| CHERRY/ANY/ANY | 2 | 0.128 |
| ANY/ANY/CHERRY | 2 | 0.128 |
| CHERRY/CHERRY/ANY | 5 | 0.094 |
| ANY/CHERRY/CHERRY | 5 | 0.094 |
| CHERRY/ANY/CHERRY | 5 | 0.032 |
| CHERRY/CHERRY/CHERRY | 20 | 0.038 |
| BAR/ORANGE/ORANGE | 14 | 0.055 |
| ORANGE/ORANGE/BAR | 14 | 0.008 |
| ORANGE/ORANGE/ORANGE | 20 | 0.079 |
| BAR/PLUM/PLUM | 10 | 0.019 |
| PLUM/PLUM/BAR | 10 | 0.005 |
| PLUM/PLUM/PLUM | 20 | 0.094 |
| BAR/BELL/BELL | 18 | 0.007 |
| BELL/BELL/BAR | 18 | 0.034 |
| BELL/BELL/BELL | 20 | 0.038 |
| BAR/BAR/BAR | 50 | 0.094 |
| 202 → 7/7/7 | 100 | 0.009 |

FIG. 8A

210

| OUTCOME DESCRIPTION | PAYOUT | EXPECTED PAYOUT |
|---|---|---|
| CHERRY/ANY/ANY | 2 | 0.128 |
| ANY/ANY/CHERRY | 2 | 0.128 |
| CHERRY/CHERRY/ANY | 5 | 0.094 |
| ANY/CHERRY/CHERRY | 5 | 0.094 |
| CHERRY/ANY/CHERRY | 5 | 0.032 |
| CHERRY/CHERRY/CHERRY | 20 | 0.038 |
| BAR/ORANGE/ORANGE | 14 | 0.055 |
| ORANGE/ORANGE/BAR | 14 | 0.008 |
| ORANGE/ORANGE/ORANGE | 20 | 0.079 |
| BAR/PLUM/PLUM | 10 | 0.019 |
| PLUM/PLUM/BAR | 10 | 0.005 |
| PLUM/PLUM/PLUM | 20 | 0.094 |
| BAR/BELL/BELL | 18 | 0.007 |
| BELL/BELL/BAR | 18 | 0.034 |
| BELL/BELL/BELL | 20 | 0.038 |
| BAR/BAR/BAR | 50 | 0.094 |
| 7/7/7 | 150 | 0.014 |

212

FIG. 8B

220

| OUTCOME DESCRIPTION | PAYOUT | EXPECTED PAYOUT |
|---|---|---|
| CHERRY/ANY/ANY | 2 | 0.128 |
| ANY/ANY/CHERRY | 2 | 0.128 |
| CHERRY/CHERRY/ANY | 5 | 0.094 |
| ANY/CHERRY/CHERRY | 5 | 0.094 |
| CHERRY/ANY/CHERRY | 5 | 0.032 |
| CHERRY/CHERRY/CHERRY | 20 | 0.038 |
| BAR/ORANGE/ORANGE | 14 | 0.055 |
| ORANGE/ORANGE/BAR | 14 | 0.008 |
| ORANGE/ORANGE/ORANGE | 20 | 0.079 |
| BAR/PLUM/PLUM | 10 | 0.019 |
| PLUM/PLUM/BAR | 10 | 0.005 |
| PLUM/PLUM/PLUM | 20 | 0.094 |
| BAR/BELL/BELL | 18 | 0.007 |
| BELL/BELL/BAR | 18 | 0.034 |
| BELL/BELL/BELL | 20 | 0.038 |
| BAR/BAR/BAR | 50 | 0.094 |
| 222 → 7/7/7 | 200 | 0.019 |

FIG. 8C

250

| | SPEED IDENTIFIER 258 | SPEED OF PLAY 260 | MULTIPLIER TO PAYOUT TABLE 262 |
|---|---|---|---|
| 252 | A | LESS THAN 4 GAMES PER MINUTE | 1.00 |
| 254 | B | 4-8 GAMES PER MINUTE | 1.02 |
| 256 | C | MORE THAN 8 GAMES PER MINUTE | 1.04 |

FIG. 9

280

| OUTCOME DESCRIPTION | PAYOUT | EXPECTED PAYOUT |
|---|---|---|
| CHERRY/ANY/ANY | 2 | 0.128 |
| ANY/ANY/CHERRY | 2 | 0.128 |
| CHERRY/CHERRY/ANY | 5 | 0.094 |
| ANY/CHERRY/CHERRY | 5 | 0.094 |
| CHERRY/ANY/CHERRY | 5 | 0.032 |
| CHERRY/CHERRY/CHERRY | 20 | 0.038 |
| BAR/ORANGE/ORANGE | 14 | 0.055 |
| ORANGE/ORANGE/BAR | 14 | 0.008 |
| ORANGE/ORANGE/ORANGE | 20 | 0.079 |
| BAR/PLUM/PLUM | 10 | 0.019 |
| PLUM/PLUM/BAR | 10 | 0.005 |
| PLUM/PLUM/PLUM | 20 | 0.094 |
| BAR/BELL/BELL | 18 | 0.007 |
| BELL/BELL/BAR | 18 | 0.034 |
| BELL/BELL/BELL | 20 | 0.038 |
| BAR/BAR/BAR | 50 | 0.094 |
| 7/7/7 | 100 | 0.009 |

FIG. 10A

290

| OUTCOME DESCRIPTION | PAYOUT | EXPECTED PAYOUT |
|---|---|---|
| CHERRY/ANY/ANY | 2 | 0.128 |
| ANY/ANY/CHERRY | 2 | 0.128 |
| CHERRY/CHERRY/ANY | 5 | 0.094 |
| ANY/CHERRY/CHERRY | 5 | 0.094 |
| CHERRY/ANY/CHERRY | 5 | 0.032 |
| CHERRY/CHERRY/CHERRY | 20 | 0.038 |
| BAR/ORANGE/ORANGE | 14 | 0.055 |
| ORANGE/ORANGE/BAR | 14 | 0.008 |
| ORANGE/ORANGE/ORANGE | 20 | 0.079 |
| BAR/PLUM/PLUM | 10 | 0.019 |
| PLUM/PLUM/BAR | 10 | 0.005 |
| PLUM/PLUM/PLUM | 20 | 0.094 |
| BAR/BELL/BELL | 18 | 0.007 |
| BELL/BELL/BAR | 18 | 0.034 |
| BELL/BELL/BELL | 20 | 0.038 |
| BAR/BAR/BAR | 51 | 0.096 |
| 7/7/7 | 102 | 0.010 |

FIG. 10B

300

| OUTCOME DESCRIPTION | PAYOUT | EXPECTED PAYOUT |
|---|---|---|
| CHERRY/ANY/ANY | 2 | 0.128 |
| ANY/ANY/CHERRY | 2 | 0.128 |
| CHERRY/CHERRY/ANY | 5 | 0.094 |
| ANY/CHERRY/CHERRY | 5 | 0.094 |
| CHERRY/ANY/CHERRY | 5 | 0.032 |
| CHERRY/CHERRY/CHERRY | 20 | 0.038 |
| BAR/ORANGE/ORANGE | 14 | 0.055 |
| ORANGE/ORANGE/BAR | 14 | 0.008 |
| ORANGE/ORANGE/ORANGE | 20 | 0.079 |
| BAR/PLUM/PLUM | 10 | 0.019 |
| PLUM/PLUM/BAR | 10 | 0.005 |
| PLUM/PLUM/PLUM | 20 | 0.094 |
| BAR/BELL/BELL | 18 | 0.007 |
| BELL/BELL/BAR | 18 | 0.034 |
| BELL/BELL/BELL | 20 | 0.038 |
| BAR/BAR/BAR | 53 | 0.100 |
| 7/7/7 | 106 | 0.010 |

FIG. 10C

1100

| OUTCOME DESCRIPTION | PAYOUT | PROBABILITY | EXPECTED PAYOUT |
|---|---|---|---|
| NONWINNING COMBINATION | 0 | 80.485% | 0 |
| CHERRY/ANY/ANY | 2 | 6.386% | 0.128 |
| ANY/ANY/CHERRY | 2 | 6.386% | 0.128 |
| CHERRY/CHERRY/ANY | 5 | 1.878% | 0.094 |
| ANY/CHERRY/CHERRY | 5 | 1.878% | 0.094 |
| CHERRY/ANY/CHERRY | 5 | 0.639% | 0.032 |
| CHERRY/CHERRY/CHERRY | 20 | 0.188% | 0.038 |
| BAR/ORANGE/ORANGE | 14 | 0.394% | 0.055 |
| ORANGE/ORANGE/BAR | 14 | 0.056% | 0.008 |
| ORANGE/ORANGE/ORANGE | 20 | 0.394% | 0.079 |
| BAR/PLUM/PLUM | 10 | 0.188% | 0.019 |
| PLUM/PLUM/BAR | 10 | 0.047% | 0.005 |
| PLUM/PLUM/PLUM | 20 | 0.470% | 0.094 |
| BAR/BELL/BELL | 18 | 0.038% | 0.007 |
| BELL/BELL/BAR | 18 | 0.188% | 0.034 |
| BELL/BELL/BELL | 20 | 0.188% | 0.038 |
| BAR/BAR/BAR | 50 | 0.188% | 0.094 |
| 7/7/7 | 100 | 0.009% | 0.009 |

1102

1104

FIG. 11A

1110

| OUTCOME DESCRIPTION | PAYOUT | PROBABILITY | EXPECTED PAYOUT |
|---|---|---|---|
| NONWINNING COMBINATION | 0 | 80.480% | 0 |
| CHERRY/ANY/ANY | 2 | 6.386% | 0.128 |
| ANY/ANY/CHERRY | 2 | 6.386% | 0.128 |
| CHERRY/CHERRY/ANY | 5 | 1.878% | 0.094 |
| ANY/CHERRY/CHERRY | 5 | 1.878% | 0.094 |
| CHERRY/ANY/CHERRY | 5 | 0.639% | 0.032 |
| CHERRY/CHERRY/CHERRY | 20 | 0.188% | 0.038 |
| BAR/ORANGE/ORANGE | 14 | 0.394% | 0.055 |
| ORANGE/ORANGE/BAR | 14 | 0.056% | 0.008 |
| ORANGE/ORANGE/ORANGE | 20 | 0.394% | 0.079 |
| BAR/PLUM/PLUM | 10 | 0.188% | 0.019 |
| PLUM/PLUM/BAR | 10 | 0.047% | 0.005 |
| PLUM/PLUM/PLUM | 20 | 0.470% | 0.094 |
| BAR/BELL/BELL | 18 | 0.038% | 0.007 |
| BELL/BELL/BAR | 18 | 0.188% | 0.034 |
| BELL/BELL/BELL | 20 | 0.188% | 0.038 |
| BAR/BAR/BAR | 50 | 0.188% | 0.094 |
| 7/7/7 | 100 | 0.014% | 0.014 |

1112 → NONWINNING COMBINATION

1114 → 7/7/7

FIG. 11B

1120

| OUTCOME DESCRIPTION 122 | PAYOUT 124 | PROBABILITY 126 | EXPECTED PAYOUT 128 |
|---|---|---|---|
| NONWINNING COMBINATION | 0 | 80.475% | 0 |
| CHERRY/ANY/ANY | 2 | 6.386% | 0.128 |
| ANY/ANY/CHERRY | 2 | 6.386% | 0.128 |
| CHERRY/CHERRY/ANY | 5 | 1.878% | 0.094 |
| ANY/CHERRY/CHERRY | 5 | 1.878% | 0.094 |
| CHERRY/ANY/CHERRY | 5 | 0.639% | 0.032 |
| CHERRY/CHERRY/CHERRY | 20 | 0.188% | 0.038 |
| BAR/ORANGE/ORANGE | 14 | 0.394% | 0.055 |
| ORANGE/ORANGE/BAR | 14 | 0.056% | 0.008 |
| ORANGE/ORANGE/ORANGE | 20 | 0.394% | 0.079 |
| BAR/PLUM/PLUM | 10 | 0.188% | 0.019 |
| PLUM/PLUM/BAR | 10 | 0.047% | 0.005 |
| PLUM/PLUM/PLUM | 20 | 0.470% | 0.094 |
| BAR/BELL/BELL | 18 | 0.038% | 0.007 |
| BELL/BELL/BAR | 18 | 0.188% | 0.034 |
| BELL/BELL/BELL | 20 | 0.188% | 0.038 |
| BAR/BAR/BAR | 50 | 0.188% | 0.094 |
| 7/7/7 | 100 | 0.019% | 0.019 |

1122 → NONWINNING COMBINATION

1124 → 7/7/7

FIG. 11C

METHOD AND APPARATUS FOR DIRECTING A GAME IN ACCORDANCE WITH SPEED OF PLAY

This application is a continuation of U.S. application Ser. No. 10/770,231, filed Feb. 2, 2004 now abandoned in the name of Walker et al and entitled "METHOD AND APPARATUS FOR DIRECTING A GAME IN ACCORDANCE WITH SPEED OF PLAY", which is incorporated by reference herein in its entirety.

FIELD OF THE INVENTION

The present invention relates to amusement devices, and more specifically to electronic chance devices.

BACKGROUND OF THE INVENTION

Casinos and other entities that derive revenue from gaming devices, such as slot machines, video poker machines and video blackjack machines, attempt to maximize revenue. Gaming devices generate revenue in accordance with the following equation:

$$\text{REVENUE}=(\text{HOUSE EDGE})\times(\text{HOURS PLAYED})\times(\text{PLAYS/HOUR})$$

Of the above three variables, two, Hours Played and Plays/Hour, are directly controlled by the player, and are thus difficult for a casino to change. The third, House Edge, is directly controlled by a casino but is nonetheless difficult to change for regulatory reasons. In addition, increasing House Edge can affect other variables to actually decrease revenue, as is described below.

Players are primarily concerned with finding a gaming device with a low "House Edge", also known as "hold percentage" (average percentage of wagered money which is kept by the gaming device per game). Equivalently, players are primarily concerned with finding a gaming device with a high "payout percentage" (100% less House Edge, which equals the average percentage of wagered money which is returned to a player per game). Low hold percentages (high payout percentages) are a significant factor in attracting players to one casino rather than another. Accordingly, many casinos advertise that they have gaming devices with very high payout percentages.

Although a high payout percentage (low House Edge) may attract players, it also results in lower revenue. Casinos, of course, would prefer higher revenue, and may increase the House Edge to increase revenue. Paradoxically, increasing the House Edge does not always increase revenue. The House Edges of gaming devices are often displayed in publications or on the gaming device itself. Many players will avoid gaming devices that they believe to have low payout percentages, or high House Edges. Thus, if the House Edge is increased on certain gaming devices, the Hours Played or Plays/Hour on those gaming devices may decrease, and revenues may likewise decrease.

In addition, when a casino wants to adjust the hold percentage of a slot machine, state and/or local regulations may require that the machine be removed from the casino floor, adjusted accordingly, then reactivated. Accordingly, some casinos may be reluctant to increase the House Edge of gaming devices in an attempt to increase revenues from those devices.

Increasing the Hours Played is difficult or impossible because a casino cannot easily modify player behavior. Casinos typically remove clocks from the view of players, make the seats and playing area more comfortable and serve free drinks in an attempt to modify player behavior. Additionally, the gaming devices themselves have become increasingly more entertaining in order to entice the player to play longer. Such measures may, at best, indirectly increase the Hours Played, but do not necessarily increase the Hours Played significantly or at all.

Increasing the Plays/Hour (speed of game play) is likewise difficult or impossible. Efforts to increase this factor include providing a spin button, rather than a handle, on some slot machines, allowing the player to initiate each game quickly. In addition, some slot machines have faster stopping reels, which end each game more quickly. Furthermore, a group of gaming machines may be in communication over a network, allowing each of a group of players to influence the movement of an object in a race, such as a horse race or car race. Such a racing game may make some players play faster than they would have. However, other players view such a game as annoyingly complicated and do not participate.

Casinos may also sponsor tournaments, in which the first player to win a jackpot or reach a certain score wins a prize. Casinos may also organize player clubs, in which players receive points for the number of plays or amounts wagered. Such points can be redeemed for goods and services once the player has reached a certain threshold. Casinos may also offer players the chance to win a "progressive jackpot", which increases over time and is typically available to all players in a casino playing slot machines. When a progressive jackpot reaches a large dollar amount, players typically play rapidly in an attempt to win that jackpot. Since each player knows that all other players have a chance to win, they play faster in an attempt to increase their chances of winning the jackpot. However, other players are not attracted by such casino promotions, and their playing behavior is thus unaffected by the promotions.

In summary, it would be advantageous to increase a player's attraction to a gaming device.

BRIEF DESCRIPTION OF THE DRAWINGS

FIG. 4 is a schematic illustration of an outcome probabilities database of the electronic gaming device of FIG. 1.

FIG. 5 is a schematic illustration of an exemplary payout table of the electronic gaming device of FIG. 1.

FIGS. 8A, 8B and 8C are schematic illustrations of one embodiment of the payout tables of FIG. 7.

FIG. 9 is a schematic illustration of another embodiment of a selection table of the electronic gaming device of FIG. 1.

FIGS. 10A, 10B and 10C are schematic illustrations of payout tables calculated in accordance with the selection table of FIG. 9.

FIGS. 11A, 11B and 11C are schematic illustrations of one embodiment of the payout tables of FIG. 7.

DETAILED DESCRIPTION OF THE PREFERRED EMBODIMENTS

Applicants have recognized that it is possible to increase the speed of play (Plays/Hour) of a gaming device significantly, and thereby significantly increase the revenue. Players typically do not consider the speed of play, but instead attempt to find a gaming device with a low House Edge. Accordingly, a gaming device that is played rapidly will not discourage players, and can thus generate more revenue by providing an incentive to play faster and for longer periods of time. Such a gaming device may generate so much revenue that the higher payout percentage will be offset.

By offering an incentive to play faster, a gaming device will typically be played more often over time than those devices that do not provide such an incentive. In this way the present invention increases a player's attraction to a gaming device embodying the present invention. The casino can in turn derive greater revenue from the gaming device, even though the player is afforded a higher payout percentage.

In jurisdictions which require a gaming device to be monitored, the gaming device could maintain an audit trail for later review by regulators. Thus, the gaming device could automatically adjust the hold percentages as desired while conforming to regulatory requirements.

In accordance with the present invention, a gaming device such as a slot machine calculates a speed of game play, and in turn determines a pay schedule or outcome probability based on the speed of game play. The pay schedule or outcome probabilities for higher speeds of game play may provide a higher payout percentage, which attracts players and provides an incentive to play faster and for longer periods of time. The greater speed of play and time period of playing may actually increase revenues derived from the gaming device, even though the payout percentage is higher.

Speed of game play may be calculated by measuring the number of games played in a predetermined time period, or the time elapsed between games. The gaming device may select a payout table from a plurality of payout tables based on this speed. Alternatively, the gaming device may determine a multiplier based on the speed of game play, and adjust a base payout table in accordance with the multiplier.

As will be understood by those skilled in the art, the drawings and accompanying descriptions presented herein are exemplary arrangements for stored representations of information. A number of other arrangements may be employed besides the tables shown. Similarly, the illustrated entries represent exemplary information, but those skilled in the art will understand that the number and content of the entries can be different from those illustrated herein.

Figure 1:
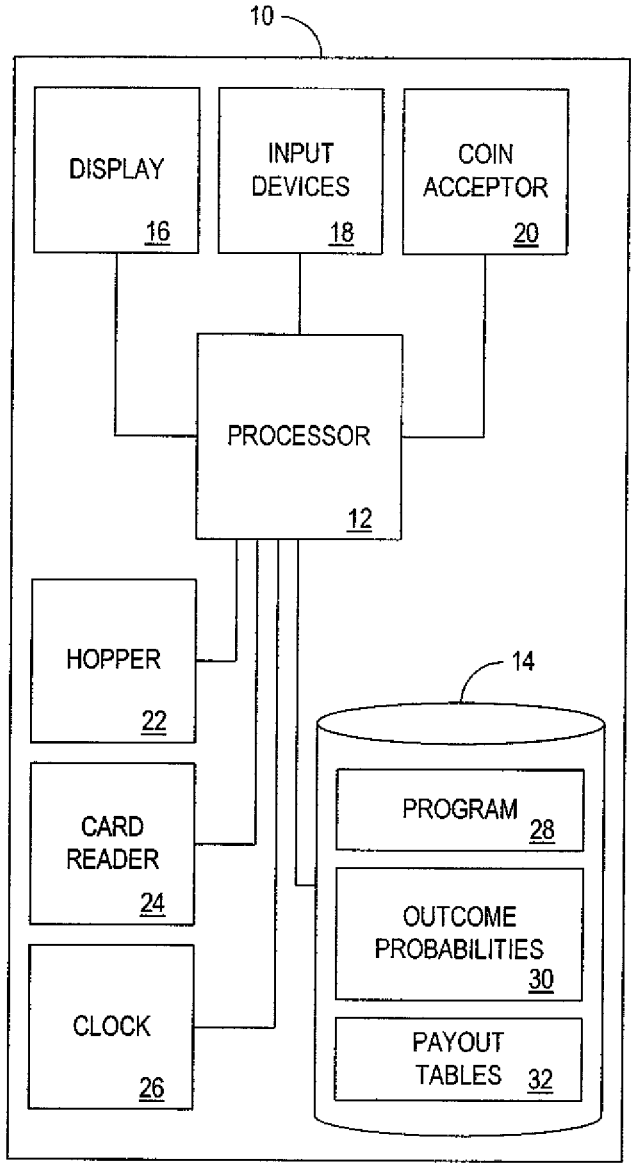
FIG. 1 is a schematic illustration of an electronic gaming device provided in accordance with the present invention.

Referring to FIG. 1, a gaming device 10 comprises a processor 12, such as one or more conventional microprocessors, which is in communication with a data storage device 14, such as an appropriate combination of magnetic, optical and/or semiconductor memory. The processor 12 and the storage device 14 may each be (i) located entirely within a single computer or other computing device; (ii) connected to each other by a remote communication link, such as a serial port cable, telephone line or radio frequency transceiver; or (iii) a combination thereof. For example, the gaming device 10 may comprise one or more computers which are connected to a remote server computer for maintaining databases.

The processor 12 is further in communication with a display 16 and player input devices 18. The display 16 is a graphical display device, such as a video monitor of a type used in conventional electronic gaming devices, for displaying images generated by the processor 12 during a game. Such images are described below. The display 16 need not be included in certain types of gaming devices, such as purely mechanical slot machines. The player input devices 18 include input devices well known in the art, such as a touch screen for generating a signal indicative of a location on the touch screen that is touched or pressed by a player, and/or buttons which indicate player commands and selections when actuated. Other input devices will be understood by those skilled in the art.

The processor 12 is further in communication with a coin acceptor 20 for generating a signal indicative of the number of coins inserted and their type. The coin acceptor 20 thereby allows the processor 12 to determine an amount of funds which are deposited by a player and retained in a coin reservoir (not shown). A hopper 22 for dispensing coins from the coin reservoir (not shown) is in communication with the processor 12. When the player requests to "cash out" (receive all funds he is due), the processor determines if the player is due any finds ("credit"). If so, the processor 12 directs the hopper 22 to release an appropriate number and type of coins in a known manner.

The processor 12 is further in communication with a card reader 24 for reading information stored on a player tracking card (not shown). Such a player tracking card may be magnetically encoded with data representing an amount of funds, and/or with data representing a player identifier, such as a player name or account number. Accordingly, a player may use a player tracking card instead of inserting coins into and receiving coins from the gaming device 10. The player identifier can be used in accessing other player-related information stored on a network server or other remote device. Thus, the card reader 24 also allows the processor 12 to receive and transmit player-related information. The card reader 24 may also include a display for displaying the value of funds stored in association with a player tracking card, thereby informing the player of an amount of funds available.

A clock 26 in communication with the processor 12 generates signals that indicate time. Thus, the processor 12 may ascertain the time of day or the time that has elapsed between two events.

The storage device 14 stores (i) a program 28 for controlling the processor 12; (ii) an outcome probabilities database 30 for indicating probabilities of game outcomes; and (iii) one or more payout tables 32 for indicating payouts (funds won) for game outcomes. The processor 12 performs instructions of the program 28, thereby operating in accordance with the present invention, and particularly in accordance with the methods described in detail herein. For example, the program 28 stores data indicative of game rules and elements. The program 28 furthermore includes program elements that may be necessary, such as an operating system and "device drivers" for allowing the processor to interface with computer peripheral devices, such as the hopper 22 and the card reader 24. Appropriate device drivers and other necessary program elements are known to those skilled in the art, and need not be described in detail herein.

In the above-described embodiment, the gaming device 10 is an electronic or electro-mechanical device similar to those used in casinos. As such, the gaming device 10 would include typical components such as the coin acceptor 20, the hopper 22 and/or the card reader 24. In another embodiment, the gaming device 10 may be implemented as software that directs one or more computers, such as conventional personal computers based on Intel Pentium® microprocessors. Furthermore, such software implementations of the gaming device 10 may be operative to implement gaming over networks, such the Internet.

Figure 2:
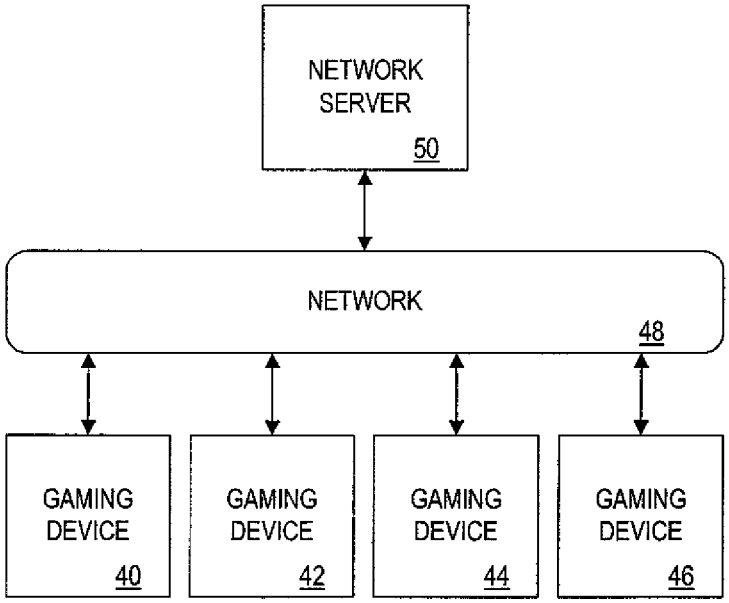
FIG. 2 is a schematic illustration of a plurality of gaming devices which are in communication with a network server.

Referring to FIG. 2, each of gaming devices 40, 42, 44 and 46 is in communication with a network 48, and is thereby in communication with a network server 50. Communication with the network server 50 allows each gaming device to access player-related information stored on the network server. Those skilled in the art will understand that many types of player-related information may be stored, such as funds and predefined game preferences. Those skilled in the art will also understand that many types of gaming devices may operate in communication with a network server, while many others may operate without any such communication to another device.

Figure 3:
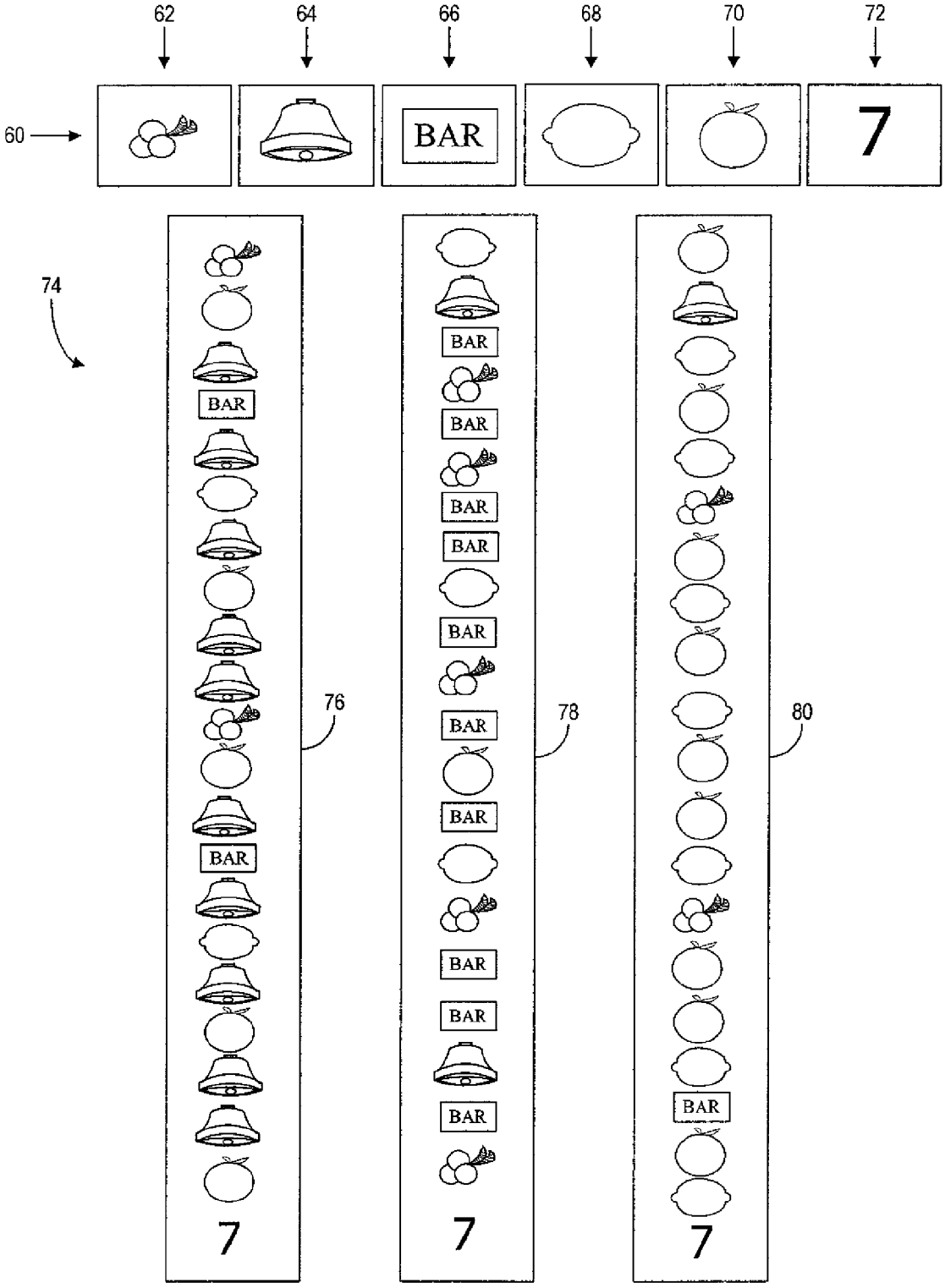
FIG. 3 is a diagrammatic representation of a set of elements of a slot machine-type game, and arrangement of those elements in a slot machine-type game.

Referring to FIG. 3, a set 60 of elements includes all possible elements of a slot machine-type game. The set 60 includes a cherries element 62, a bell element 64, a bar element 66, an orange element 68, a plum element 70 and a seven element 72. During such a game, the device randomly selects one element from each of a plurality of reels, yielding a subset of elements that defines the outcome for that game. For example, one possible subset is a bar element, a plum element and a bell element. Another possible subset is an orange element and two cherry elements.

For each reel in a slot machine-type game, the selected element is one of twenty-two equally likely choices, each choice being one of the set 60 of all possible elements. For example, a plurality 74 of reels includes reels 76, 78 and 80, and the player is randomly provided with an element chosen from each of the reels 76, 78 and 80, thereby yielding a subset that consists of three elements. The three elements define the outcome, and therefore a payout.

It is noted that the number of choices is greater than the number of elements. For example, although there are six elements 62, 64, 66, 68, 70 and 72, there are twenty-two choices on each reel, and therefore there are 10,648 possible arrangements of elements for each game (22×22×22×10,648).

Referring to FIG. 4, the outcome probabilities database 30 of FIG. 1 is shown in detail. Each row of the depicted database represents a database entry, and each entry defines a probability of an outcome occurring. In particular, each entry includes an outcome description 100 which describes the outcome, and a number of arrangements of elements 102 which indicates the number of arrangements of elements which yield the outcome. For example, the entry 110, corresponding to the outcome "orange/orange/orange", indicates that there are forty-two arrangements of elements which yield the outcome "orange/orange/orange". This is because, as shown in FIG. 3, the reel 76 has two orange elements, the reel 78 has three orange elements and the reel 80 has seven orange elements (2×3×7=42). Similarly, the entry 112, corresponding to the outcome "bar/bell/bell", indicates that there are four arrangements of elements which yield the outcome "bar/bell/bell." This is because, as shown in FIG. 3, the reel 76 has two bar elements, the reel 78 has two bell elements and the reel 80 has one bell element (2×2×1=4).

Each entry of the outcome probabilities database 30 further includes a probability 104 which indicates the probability during each game of the outcome occurring. For example, the entry 110, corresponding to the outcome "orange/orange/orange", indicates that there is a probability of 0.394% of the outcome "orange/orange/orange" occurring. This is because, as discussed above, there are forty-two arrangements of elements which yield the outcome "orange/orange/orange", and there are 10,648 possible arrangements of elements (42/10,648=0.00394=0.394%). Similarly, the entry 112, corresponding to the outcome "bar/bell/bell", indicates that there is a probability of 0.038% of the outcome "bar/bell/bell" occurring. This is because, as discussed above, there are four arrangements of elements which yield the outcome "bar/bell/bell", and there are 10,648 possible arrangements of elements (4/10,648=0.00038=0.038%).

Each entry further includes a random number range 106 which indicates a range of random numbers that correspond to an occurrence of the outcome. For example, in the embodiment illustrated by FIG. 4 a random integer from 1 to 10,648 is selected for each game. Accordingly, each integer from 1 to 10,648 corresponds to one of the entries of the outcome probabilities database 30. The random number range 106 for each entry is selected in accordance with the corresponding probability 104. For example, the entry 110 indicates that a randomly selected integer which is from 10,467 to 10,508 corresponds to the outcome "orange/orange/orange". Since the range from 10,467 to 10,508 consists of forty-two integers, and the randomly selected integer may be from 1 to 10,648, the probability of the outcome "orange/orange/orange" occurring is 0.394% (42/10,648=0.00394=0.394%).

Note that the random number ranges 106 in FIG. 4 include for each combination a number of integers equal to the number of ways in which the corresponding combination may arise. In other words, for a given combination, the number of arrangement of elements 102 is equal to the number of integers in the random number range 106. As an example, there are listed six hundred eighty ways in which the combination "cherry/any/any" may occur. The random number range 106 corresponding to "cherry/any/any" is listed as "8571-9250". The number of integers in the range "8571-9250" is also equal to six hundred eight.

However, in various embodiments, random number ranges corresponding to a particular combination need not include a number of integers equal to the number of arrangements of elements that yield the combination. For example, even though only one arrangement of elements yields the combination "7/7/7", there may be twenty integers in a random number range corresponding to the combination "7/7/7". As is well known in the art, a combination may be chosen as an outcome of a particular handle pull by using a random number generator to determine a random integer, and choosing the combination if the randomly chosen integer falls within a random number range corresponding to the combination. Of course, there are many other ways of choosing a combination, such as using a separate random number to determine the symbol on each reel. In any event, it follows that the probability of occurrence of a particular combination need not be based on the number of arrangements of elements that will yield the combination. In the prior example using "7/7/7", the probability of the combination's occurrence may thus be set to 20/10648, even though there is only one arrangement that yields "7/7/7". Embodiments involving changing probabilities for particular combinations will be described further herein.

Referring to FIG. 5, an exemplary payout table 120 of the payout tables 32 (FIG. 1) is illustrated. Each row of the payout table 120 indicates a payout for an outcome. The payout table 120 thus defines a possible pay schedule for a game. As described below, the actual pay schedule of a game may vary over time, and may correspond to any of a number of payout tables. A pay schedule as used herein indicates the payouts actually provided for outcomes of a game.

Each entry of the payout table 120 includes (i) an outcome description 122 that describes the outcome; (ii) a payout 124 that indicates the number of coins awarded to the player when the outcome occurs, in which the payout 124 is for each coin the player wagers (e.g. payout of four indicates four coins awarded for every coins wagered); (iii) a probability 126 which indicates the probability during each game of the outcome occurring; and (iv) an expected payout 128 which indicates the average number of coins awarded for each game that are due to the outcome. As is known in the art, the expected payout 128 is an "expected value" which is equal to the sum of all products of each payout multiplied by the corresponding probability of the payout occurring. It is noted that the sum of all expected payouts shown in the payout table 120 is approximately 0.954, and as is known the payout percentage is defined as the sum of all expected payouts expressed as a percentage. Thus, the payout percentage of a gaming device operating according to the payout table 120 is approximately 95.4%. Equivalently, the hold percentage, or House Edge, is approximately 4.6%.

Figure 6:
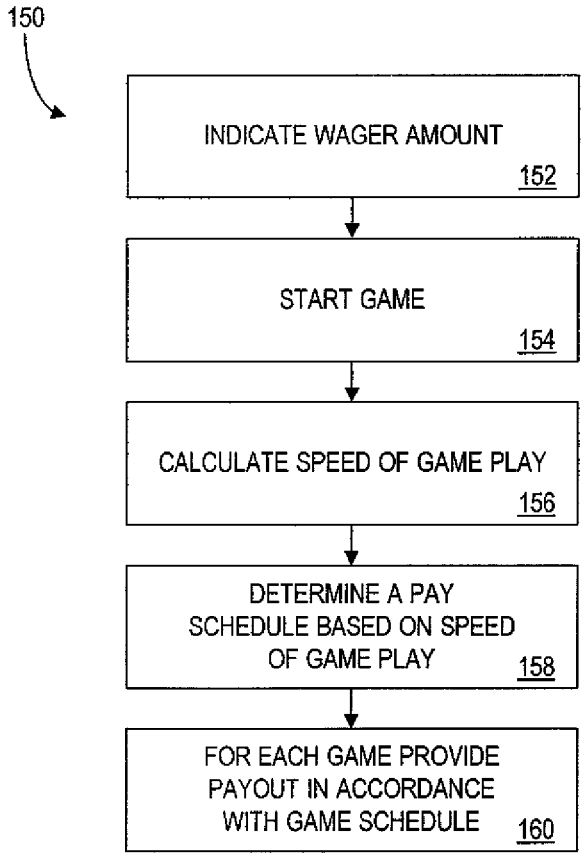
FIG. 6 is a flowchart illustrating a process for directing a game in accordance with the present invention.

Referring to FIG. 6, a process 150 initiates with the payer indicating a wager amount for a game (step 152) and starting the game (step 154). The gaming device 10 (FIG. 1) calculates a speed of game play, as is described below, in any of a number of manners (step 156). Based on the calculated speed of game play, the gaming device determines a pay schedule (step 158). The player is then provided with a payout in accordance with the determined pay schedule (step 160).

The step 156 of calculating a speed of game play may comprise measuring a number of games played in a predetermined time period, measuring a time elapsed between games, or measuring a time elapsed between other events. The clock 26 (FIG. 1) of the gaming device 10 (FIG. 1) may be used to measure a time period and a time elapsed. Such measurements may be initiated upon the start of a game. For example, the clock 26 may measure a time elapsed between consecutive games of a series of games. Similarly the clock 26 may measure a number of games played in a time period that begins upon the start of a game. In other embodiments, measurements may be initiated after a predetermined delay, which may be measured in units of time, number of games or a combination thereof. For example, the speed of game play may be measured as the number of games played within a five minute period, in which the five minute period begins after thirty seconds of a first game being initiated. Alternatively, the speed of game play may be measured as the number of games played within a five minute period, in which the five minute period begins after fifteen games are played within a ninety second time period.

Once the speed of game play is calculated, the gaming device determines a pay schedule based on the calculated speed of game play. In general, a pay schedule may be determined by (i) selecting a payout table from a plurality of payout tables based on the speed of game play, or (ii) multiplying the payout values of a payout table by a multiplier that is based on the speed of game play.

As mentioned above, a speed of play may be measured or estimated based on an elapsed time interval between many types of events. Such events may include: (i) the occurrence of a particular outcome, such as "cherry/cherry/cherry"; (ii) the occurrence of a particular symbol, such as "plum"; (iii) the occurrence of a particular number of symbols (e.g., a measuring time starts when a fifth "orange" symbol occurs, regardless of when earlier "orange" symbols occurred); (iv) the occurrence of a particular number of like outcomes (e.g., a measuring time starts when the third "bar/bar/bar" occurs; (v) the occurrence of a particular sequence of outcomes (e.g., "cherry/bar/any" occurs on a handle pull immediately following "plum/bell/any"); (vi) the occurrence of a particular sequence of symbols (e.g., "plum" occurs in the outcome of a first pull, and "cherry" occurs in the outcome of the next pull); (vii) the initiation of a bonus round; (viii) the occurrence of a payout of a certain amount; (ix) the occurrence of a certain number of consecutive losses; and so on. Additionally, a measured time interval may include an interval between any two or more of the above events, in any particular order. For example, a measured time interval may begin when a player loses three times in a row, and end when a player achieves an outcome "plum/plum/bell". A measured time interval may also begin at an arbitrary or desired time (e.g., at a time chosen by the gaming device or server), and may end with one of the above events.

In various embodiments, a pay schedule may be determined directly based on the elapsed time between two or more events, such as the events described above. For example, if less than twenty minutes has elapsed between two outcomes of "plum/bell/bar", then a first pay schedule may be selected. However, if more than twenty minutes has elapsed, then a second pay schedule may be selected. The second pay schedule may have a higher house edge than the first.

In various embodiments, a measure of an elapsed time between certain events may be used to estimate a rate of play. The rate of play may be estimated based on the elapsed time, and based on the probability of occurrence of the events defining the bounds of the measured time interval. An example is illustrated below.

Suppose a measured time interval starts immediately upon the conclusion of a game. The measured time interval ends when event E occurs. Suppose further that event E occurs with probability p during any given handle pull. It follows that the probability that event E will occur for the first time after one handle pull is p. The probability that event E will occur for the first time after two handle pulls is $p*(1-p)$. The probability that event E will occur for the first time after three handle pulls is $p*(1-p)^2$. In general, the probability that event E will occur for the first time after k handle pulls is $p*(1-p)^{k-1}$. The expected number of handle pulls required before event E occurs is therefore equal to:

$$\begin{aligned}\sum_{k=1\ldots\infty} k*p*(1-p)^{k-1} &= p*\sum_{k=1\ldots\infty} k*(1-p)^{k-1}\\ &= -p*d\Big/dp\Big(\sum_{k=1\ldots\infty}(1-p)^k\Big)\\ &= -p*d/dp((1-p)/p)\\ &= -p*(-p-(1-p))/p^2\\ &= 1/p\end{aligned}$$

The rate of play may be estimated to be the expected number of handle pulls divided by the measured time interval. Thus, if the measured time interval is denoted "t", the rate of play may be estimated to be $1/(p*t)$.

To use a more tangible example, suppose that a measured time interval will begin immediately and end upon the occurrence of a combination of the form "cherry/any/cherry". Suppose further that the combination "cherry/any/cherry" occurs after 20 minutes of play. According to the table of FIG. 4, the probability of the combination "cherry/any/cherry" occurring on a given handle pulls is 0.639%. The rate of play may therefore be estimated as $1/(p*t)=1/(0.639\%*20 \text{ minutes})=7.83/\text{minute}$, or 7.83 handle pulls per minute. Consistent with the present invention, a pay schedule may be determined based upon an estimated rate of play even if the rate of play is not measured directly.

In various embodiments, a rate of play may alternatively be estimated by measuring the number of a particular event or group of events within a fixed time period. For example, a rate of play may be estimated based upon the number of outcomes "any/any/cherry" that occur within a ten-minute interval.

In various embodiments, a pay schedule may be determined directly from a measure of a particular number of events per unit time, even if such events do not correspond to discrete handle pulls. For example, if a person achieves at least three outcomes of the form "any/any/cherry" in a ten minute period, then the person may be eligible to receive the benefit of a first pay schedule. However, if the person achieves at least six outcomes of the form "any/any/cherry" in a ten minute period, then the person may be eligible to receive the benefit of a second pay schedule.

Figure 7:
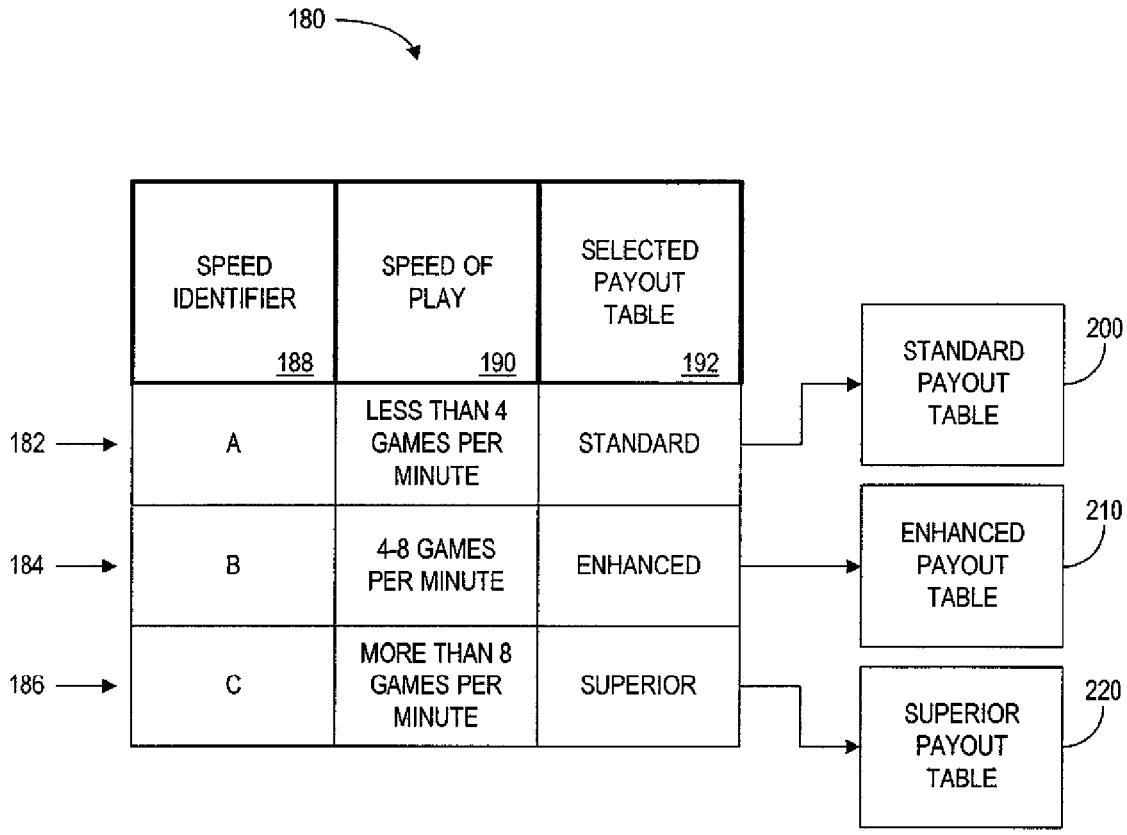
FIG. 7 is a schematic illustration of a selection table and payout tables of the electronic gaming device of FIG. 1.

Referring to FIG. 7, a selection table 180 for selecting a payout table from a plurality of payout tables based on the speed of game play is illustrated. Those skilled in the art will understand that the selection table 180 may be implemented as a database stored in the storage device 14 (FIG. 1), may be implemented by process steps defined by the program 28 (FIG. 1), or a combination thereof. The selection table 180 includes entries 182, 184 and 186, each of which indicates a payout table to select upon calculating a speed of game play. Each of the entries 182, 184 and 186 includes (i) a speed identifier 188 for uniquely identifying the entry; (ii) a speed of play 190 range; and (iii) a selected payout table 192 for indicating which of a plurality of payout tables is to be the pay schedule for a game. In the example illustrated by FIG. 7, the selected payout table 192 may indicate one of three payout tables 200, 210 and 220, which are named "standard", "enhanced" and "superior", respectively, for reference purposes. For example, if the speed of game play is calculated to be six games per minute, then the entry 184 indicates that the enhanced payout table 210 is to be the pay schedule. Those skilled in the art will understand that the selection table 180 may include any number of payout tables and/or entries.

Referring to FIGS. 8A, 8B and 8C, the payout tables 200, 210 and 220 are illustrated in detail. Each of the payout tables 200, 210 and 220 indicates similar payouts for the various outcomes except the payout for the "seven/seven/seven" outcome. The entry 202 defines the payout for that outcome to be one hundred, the entry 212 defines the payout to be one hundred fifty and the entry 222 defines the payout to be two hundred. Accordingly, the payout table 220 defines a payout percentage which is higher than that of the payout table 210. Similarly, the payout table 210 defines a payout percentage which is higher than that of the payout table 200. However, as described above, the higher speed of play can compensate for the higher payout percentages (lower hold percentages). As indicated by Table 1, the revenue derived from the gaming device can actually be higher even when the hold percentage is lower.

TABLE 1

Revenue Calculations for Selection Table 180

| | STANDARD | ENHANCED | SUPERIOR |
|---|---|---|---|
| Payout Percentage | 95.4% | 95.8% | 96.3% |
| Hold Percentage | 4.6% | 4.2% | 3.7% |
| Minimum Plays per Minute | 1 | 4 | 9 |
| Maximum Plays per Minute | 3 | 8 | — |
| Minimum Average Revenue per Minute | 0.046 | 0.167 | 0.333 |

TABLE 1-continued

Revenue Calculations for Selection Table 180

| | STANDARD | ENHANCED | SUPERIOR |
|---|---|---|---|
| Maximum Average Revenue per Minute | 0.139 | 0.334 | — |

In Table 1, minimum and maximum average revenue per minute are calculated by multiplying the hold percentage with the minimum and maximum plays per minute, respectively. In addition, the listed values for revenue are in proportion to the amount wagered. For example, the maximum average revenue per minute of 0.046 indicates a revenue per minute of 4.6 cents for games in which a dollar (100 cents) is wagered.

As noted above, in the example illustrated by FIGS. 8A, 8B and 8C, each of the payout tables 200, 210 and 220 indicates similar payouts for the various outcomes except the payout for the "seven/seven/seven" outcome. However, those skilled in the art will understand that the plurality of payout tables may indicate similar or vastly dissimilar payouts, and likewise may indicate equal or unequal payout percentages. Typically, payout percentage will be higher for payout tables which are selected for higher speeds of game play, and the revenue per time period will typically be higher for higher speeds of game play. It can be especially advantageous to increase only the payout for unlikely outcomes, such as the outcome having the highest payout (e.g. a "jackpot" outcome). Even doubling the payout of an extremely unlikely event can attract players while also resulting in a payout percentage that is still acceptable to a casino.

FIG. 9 illustrates a selection table 250 for determining a pay schedule by multiplying the payout values of a predetermined payout table ("base payout table") by a multiplier that is based on the speed of game play. Those skilled in the art will understand that the selection table 250 may be implemented as a database stored in the storage device 14 (FIG. 1), may be implemented by process steps defined by the program 28 (FIG. 1), or a combination thereof. The selection table 250 includes entries 252, 254 and 256, each of which indicates a multiplier that is based on a speed of game play. Each of the entries 252, 254 and 256 includes (i) a speed identifier 258 for uniquely identifying the entry; (ii) a speed of play 260 range; and (iii) a multiplier 262 for indicating an amount by which to multiply the payout values of the base payout table. Since a payout (number of coins won per coin wagered) is typically an integer, a product of the multiplier and a payout may be rounded down to the highest integer value. For example, for a multiplier 1.04 and a payout 20, the product is $1.04 \times 20 = 20.8$, which rounds down to 20. In many cases, this rounding down will result in an unchanged payout.

The speed of play thus indicates a multiplier. For example, if the speed of game play is calculated to be nine games per minute, then the entry 256 indicates that the multiplier is 1.04. Those skilled in the art will understand that any number of multipliers and/or entries in the selection table 250 may be used.

Referring to FIGS. 10A, 10B and 10C, payout tables 280, 290 and 300 are illustrated in detail. The payout tables 280, 290 and 300 correspond to the multipliers of FIG. 9 applied to a base payout table, which is equal to the payout table 120 of FIG. 5. The payout table 280 corresponds to the speed of play indicated by the entry 252, and thus to a multiplier of 1.00. Thus, the payout table 280 indicates the same payouts as the base payout table. The payout tables 290 and 300 correspond to the speeds of play indicated by the entries 254 and 256, respectively, and thus to multipliers of 1.02 and 1.04, respectively. Accordingly, the payout table 300 defines a payout percentage which is higher than that of the payout table 290. Similarly, the payout table 290 defines a payout percentage which is higher than that of the payout table 280. However, as indicated by Table 2, the revenue derived from the gaming device can actually be higher even when the hold percentage is lower.

TABLE 2

Revenue Calculations for Selection Table 250

| | TABLE 280 | TABLE 290 | TABLE 300 |
|---|---|---|---|
| Payout Percentage | 95.4% | 95.6% | 96.0% |
| Hold Percentage | 4.6% | 4.4% | 4.0% |
| Minimum Plays per Minute | 1 | 4 | 9 |
| Maximum Plays per Minute | 3 | 8 | — |
| Minimum Average Revenue per Minute | 0.046 | 0.177 | 0.362 |
| Maximum Average Revenue per Minute | 0.139 | 0.355 | — |

In some embodiments, a pay schedule may be selected based on the probabilities of occurrence of one or more combinations contained therein. Referring to FIGS. 11A, 11B and 11C, payout tables 1100, 1110 and 1120 are illustrated in detail. Each of the payout tables 1100, 1110 and 1120 indicate similar probabilities for the various outcomes except the probabilities for the "nonwinning combination" outcome and the "seven/seven/seven" outcome. The entry 1102 defines the probability for that outcome to be 80.485%, the entry 1112 defines the probability to be 80.480% and the entry 1122 defines the probability to be 80.475%. Meanwhile, the entry 1104 defines the probability for that outcome to be 0.009%, the entry 1114 defines the probability to be 0.014% and the entry 1124 defines the probability to be 0.019%. Accordingly, the payout table 1120 defines a payout percentage which is higher than that of the payout table 1110. Similarly, the payout table 1110 defines a payout percentage which is higher than that of the payout table 1100. As can readily be derived, the payout percentages for tables 1100, 1110, and 1120 are the same as those for tables 800, 810, and 820, respectively. Namely, the respective payout percentages are 95.4%, 95.8%, and 96.3%. As described above, the higher speed of play can compensate for the higher payout percentages (lower hold percentages). As indicated by Table 1, the revenue derived from the gaming device can actually be higher even when the hold percentage is lower. As will further be appreciated, a difference between two pay tables in a first probability of a first outcome may necessitate a difference in a second probability of a second outcome. In this way, the sum of probabilities for all possible outcomes is maintained at one. Thus, for example, a comparison of tables 1100 and 1110 shows a change of probability for two different outcomes.

The probability of an outcome may be varied from pay table to pay table in a number of ways. In some embodiments, a random number range corresponding to a particular outcome is expanded to include additional integers (e.g., to increase the probability of the corresponding outcome's occurrence), or reduced to include fewer integers (e.g., to decrease the probability of the corresponding outcome's occurrence). For instance, in order to achieve the probability for the outcome "7/7/7" illustrated in table 1120, the random number range corresponding to "7/7/7" may be expanded to include "10,647-10,648". With two integers in this range, and with one integer selected at random from the range "1-10,648", the probability of "7/7/7" becomes 2/10,648, or 0.019%. In some embodiments, a total range from which random numbers are selected may be expanded or reduced. If the total range is expanded, while the range corresponding to a particular outcome is held fixed, then it will be appreciated that the probability of occurrence of the outcome will be reduced. Conversely, if the total range is reduced, while the range corresponding to a particular outcome is held fixed, then the probability of occurrence of the outcome will be increased. It will be appreciated that the probability of an outcome's occurrence may also be varied by simultaneously changing the total range and the range corresponding to the outcome.

In some embodiments, the probability of occurrence of a particular outcome may be changed by adding or removing symbols from the reels of a gaming device. For example, if a physical or virtual reel (e.g., a representation of a physical reel stored in memory), has a fixed length, and each symbol on the reel is equally likely to occur in an outcome, then adding or subtracting symbols may change the number of possible combinations of symbols that can yield a particular outcome. For instance, removing a "cherry" symbol from the first reel of a gaming device may result in fewer possible combinations for the outcome "cherry/any/any", which may in turn reduce the probability of occurrence of the outcome "cherry/any/any".

In some embodiments, the probability of occurrence of an outcome may be altered through the addition or removal of "wild" symbols. Wild symbols may take the place of one or more other symbols in creating the combination for an outcome. For example, an outcome of "wild/7/7" may be equivalent to "7/7/7", as the wild symbol may act as a "7" so as to result in the highest paying outcome. Thus, with the addition of wild symbols "7/7/7" and/or other outcomes may occur with greater probability. Similarly, if wild symbols are removed from a game (e.g., removed from the reels of a gaming device, or removed from a deck of cards) then the probabilities of certain outcomes may be reduced. In related embodiments, the probability of the occurrence of one or more outcomes may be changed by designating a symbol to be wild. For example, in a game of poker, all threes may be designated as wild. This may increase the probability of occurrence of various winning outcomes. Similarly, symbols that are already designated as wild may be un-designated, with a corresponding effect on the probabilities of occurrence of various outcomes.

In some embodiments, the payout percentage of a pay schedule may be altered through the addition or subtraction of combinations altogether. For example, in a game of video poker, a new combination designated a "wrap-around straight" may be added to a pay schedule. The new combination may have an associated payout where it had none before. Thus, the payout percentage of a gaming device may increase with the addition of combinations. Similarly, certain combinations may be removed from a pay schedule. For example, "cherry/any/any" may be removed as a winning combination. The payout percentage of a gaming device may thereby be reduced.

In some embodiments, a pay schedule may be based upon multiple games, or handle pulls at a gaming device. For example, a pay schedule may describe a first payout if a player obtains a total of ten "cherry" symbols over the course of a designated number of handle pulls, and a second payout if the player obtains a total of eight "cherry" symbols. In such embodiments, the probability of the player achieving a certain outcome or result may be varied by varying the time allowed, or the number of handle pulls in which a player must obtain the outcome or result. To continue the prior example, the probability of the player obtaining a certain number of "cherry" symbols may be altered by giving the player more handle pulls in which to obtain the "cherry" symbols. For example, a player may be more likely to obtain ten "cherry" symbols if given ten handle pulls than if he is given only five handle pulls.

In another embodiments, a pay schedule is based upon a game in which a player advances a character on a game board. The player may advance the character by achieving certain outcomes during handle pulls. For example, an outcome may indicate that a game character is to advance three spaces on the game board. The player may be paid according to a pay schedule where payouts are based on locations on the game board that have been reached by a game character. For instance, a first payout is made if a game character reaches a first location, and a second payout is made if a game character reaches a second location. In a game board embodiment, the probability with which a game character reaches a certain location on the game board may be altered by altering the layout of the game board. For instance, extra spaces may be inserted into the game board in order to make it more difficult for a game character to reach the final space. Alternatively, trap doors may be added to the game board. The trap doors may steer a game character away from the optimal path to the final space. As will be appreciated, there are many other ways of altering a probability of achieving a certain outcome or result in a game. In some embodiments, the present invention contemplates all the ways of adjusting such a probability in order to effect the payout percentage of a pay schedule.

In various embodiments of the present invention, it may be difficult to estimate a rate of play at certain times. For example, when a player makes the first few pulls of a gaming session, there is little data based upon which to judge a rate of play. Accordingly, even though a player may in fact play rapidly from the very start of a session, the player may not receive the benefit of enhanced, superior, or other improved pay schedules until he is well into a session.

Therefore, in one or more embodiments, a pay schedule may be applied retroactively to a player. At a first point in time, such as at the time a player achieves an outcome, a player may receive a first payout based on a first pay schedule. At a second point in time after the first point in time, it may be determined that a second pay schedule should be retroactively applied to the outcome achieved at the first point in time. If a second payout from the second pay schedule corresponding to the outcome is greater than the first payout, then the player may be paid the difference. For example, suppose a player achieves an outcome of "7/7/7" during the first game of a session. The player is paid one hundred coins using "standard" pay schedule 200. Suppose further that the player continues playing games rapidly. The gaming device may subsequently determine that "superior" pay schedule 220 would have been used had it been recognized how fast the player would make handle pulls. Thus, the gaming device may determine that the superior pay schedule should be retroactively applied to the player's outcome of "7/7/7". The superior pay schedule pays 200 coins for the outcome "7/7/7". Since the player will have already been paid 100 coins using the standard pay schedule, the player may receive an additional 100 coins.

Figure 12:
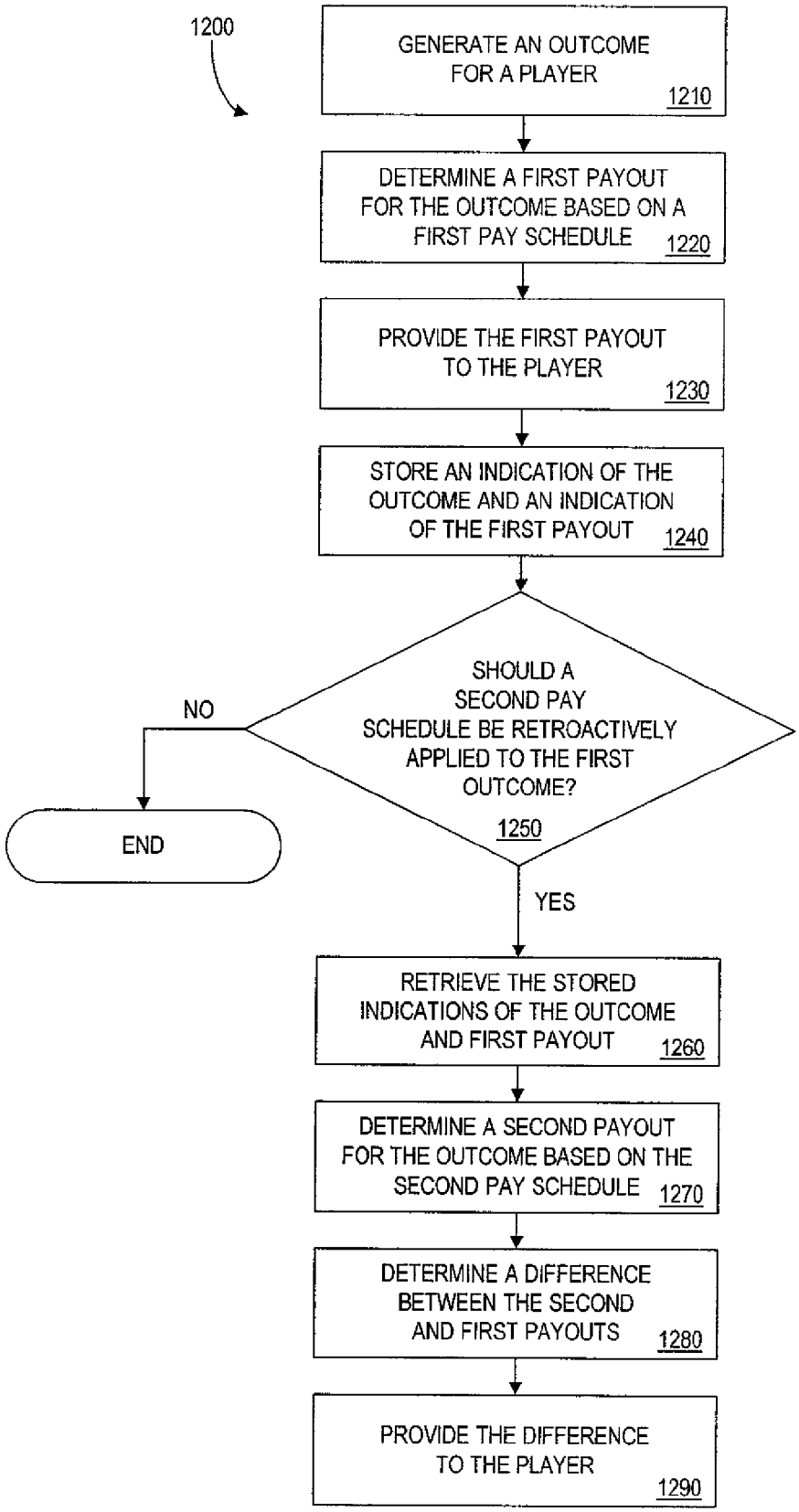
FIG. 12 is a flowchart illustrating a process for directing a game in accordance with the present invention.

Embodiments involving retroactively applied pay schedules are described more fully with reference to FIG. 12. At step 1210, a gaming device generates an outcome for a player. At step 1220, the gaming device determines a first payout for the outcome based on a first pay schedule. At step 1230, the gaming device provides the first payout to the player. At step 1240, the gaming device stores an indication of the outcome and an indication of the first payout. Note that the gaming device may just as well store an indication of the outcome and an indication of the first pay schedule, as the first payout may be derived from knowledge of the first outcome and pay schedule.

At step 1250, the gaming device determines whether a second pay schedule should be retroactively applied to the outcome. In making such a determination, the gaming device may determine whether the player's rate of play has exceeded a certain threshold. The gaming device may also determine whether the handle pull on which the player achieved the outcome should be factored in to a current measure of a rate of play. For example, if the player made handle pulls at a slow rate for the first twenty handle pulls after achieving the outcome, but later picked up the pace, then the gaming device may decide that the handle pull on which the player achieved the first outcome should not count in a current measure of a rate of play. The gaming device may also make the determination of step 1250 based on whether the payout for the second pay schedule is greater than the payout for the first pay schedule corresponding to the outcome. For example, if the first pay schedule has a greater payout for the outcome, then the gaming device may not retroactively apply the second pay schedule, as such a retroactive application might involve retracting moneys already paid out.

If, after step 1250, the gaming device determines not to retroactively apply the second pay schedule, then process 1200 ends. However, if the gaming device decides to retroactively apply the second pay schedule, flow proceeds to step 1260. At step 1260, the gaming device retrieves the stored indications of the outcome and first payout. At step 1270, the gaming device determines a second payout for the outcome based on the outcome and the second pay schedule. For instance, the second payout may be the payout corresponding to the outcome in the second pay schedule. At step 1280, the gaming device determines the difference between the second payout and the first payout. Then, at step 1290, the gaming device provides this difference to the player. It will be appreciated that the process steps 1200 may be carried out in any practicable order while still falling within the scope of the present invention. In addition, it will be appreciated that additional steps may be added, and/or steps may be left out, while still maintaining the spirit of the present invention.

The retroactive application of pay schedules provides a number of advantages. A player who achieves a winning outcome may be motivated to continue playing at a gaming device in the hopes of garnering even greater winnings when a larger payout is retroactively applied to the winning outcome. A player may be further motivated to engage in certain behaviors, such as rapid play, that will trigger a retroactive application of a pay schedule. Such behaviors may lead to greater profits for a casino.

In should be noted that any benefit may be provided to a player retroactively. For instance, rather than applying a retroactive pay schedule to a winning outcome achieved by a player, a gaming device may provide free handle pulls, a fixed payout, a free entry into a bonus round, an ability to select one or more symbols of an outcome, and so on. In addition, a casino may provide benefits such as free or discounted hotel rooms, meals, show tickets, and so on.

In various embodiments, although a player's speed of play may not be immediately discernable (e.g., the player has just begun playing), the gaming device or network server may infer an initial rate of play. Such an initial rate of play may be a universally applicable default rate of play. Alternatively, the initial rate of play may be inferred based on historical rates of play as measured from prior players at the casino or at the particular gaming device. In some embodiments, the network server may store a historical rate of play in association with a player. For example, a network server may store an average rate of play for a player over his last five sessions. If the player later inserts his player tracking card (or otherwise provides an identifier), the network server may retrieve the player's historical rate of play, and use the rate as the starting rate for a session. Accordingly, the applicable pay schedule at the start of the session may be based upon the historical rate of play.

In one embodiment, a player may achieve a first winning outcome and receive a first corresponding payout. The winning outcome may remain displayed in a corner of a display screen of the player's gaming device as the player continues to initiate handle pulls. If the player again achieves the same winning outcome, the player may be paid for the latest outcome. However, the player may also receive an additional payout for the first of the winning outcomes. In other words, a player can continue to earn payouts on an outcome if like outcomes are subsequently achieved. This scheme is analogous in some ways to a commission-based sales system, where a seller to a first party may earn further commissions on sales made by the first party to a second party. A player who achieves winning outcomes may thus be motivated to remain at a gaming device so that the outcomes may continue to "earn" further payouts. Of course, a player may receive additional payouts for a first outcome based on any event, such as achieving a second outcome that is not identical to the first outcome. Additionally, a player may earn payouts for a first event based on the subsequent achievement of a second event, even if the first event is not the occurrence of a particular outcome. For example, the first event may be the occurrence of two "7" symbols in an outcome. The player need not necessarily receive a payout for the first event. However, the player may receive a payout for each subsequent "7" that occurs in future outcomes.

In various embodiments, a player's speed of play may be indicated by a gaming device. The indication may take the form of (i) a numerical speed expressed in pulls per unit time (e.g., 10 pulls per minute); (ii) a graphical depiction of a speed in relation to a target speed (e.g., the level of mercury in a thermometer as a percentage of the total volume of the thermometer indicates the player's current speed as a percentage of a speed required to achieve a more favorable pay schedule); (iii) a colored display where, for example, reds and other colors near the bottom of the spectrum indicate slow speeds, while purples and other colors near the top of the spectrum indicate rapid speeds; (iv) a graphical depiction of a dial or other meter indexed from "slow" to "fast", with an indicator pointing somewhere in between; (v) a depiction of a character moving at a speed proportional to the player's rate of play (e.g., a horse runs around a track at a speed proportional to the player's rate of play); and on. When a gaming device indicates a player's speed, the player may become better aware of his speed, and may be motivated to play more rapidly.

A gaming device may also provide indications of a pay schedule to be applied to a player should the player play at one or more speeds. For example, a gaming device may display a "superior" pay schedule along with a message saying, "Play a little faster and you can use this pay schedule. The jackpot is twice the normal level!" Indications of a pay schedule may further motivate a player to play more rapidly.

In one or more embodiments, an applicable pay schedule may be determined based on rates other than just a rate of completing handle pulls. In some embodiments, a pay schedule is determined based on a rate at which a player makes wagers, i.e., a rate of coin-in. Such a rate may be expressed in terms of dollars per minute, coins per minute, tokens per minute, yen per minute, or some other expression of currency per unit time. Notably, if a first player has a higher rate of play than a second player, the second player may still have a higher rate of coin in. For example, a first player may wager one coin per handle pull and make ten handle pulls per minute. The first player's rate of coin-in is then ten coins per minute. A second player may wager two coins per handle pull and make seven handle pulls per minute. The second player's rate of coin-in is then fourteen coins per minute. Although the second player's rate of play is slower, his rate of coin-in is higher. Accordingly, the second player may receive the benefit of a more favorable pay schedule that does the first player. In some embodiments, a pay schedule may be determined based on a rate of lines wagered per unit time. For example, a player who plays three paylines per game, and plays ten games per minute, plays a total of thirty paylines per minute.

Varying embodiments of the present invention may use different time windows for calculating a speed of play. Time windows of different sizes have different advantages and disadvantages. For example, in an embodiment involving a short time window, a speed of play may be calculated based on the number of handle pulls made in the last minute. An embodiment involving a short time window has the advantage of quickly detecting changes in a player's rate of play. For example, if a player begins a session at a slow rate of play, but then increases his speed of play rapidly, then this increase will be detected quickly. However, using a short time window has the disadvantage of calculating a rate of play based on a potentially anomalous sample. For example, a player who has hitherto played rapidly may take a one-minute break in order to talk to a friend. If the player's rate of play is measured over the time window in which he takes a break, then the player may be ascribed an unfairly low rate of play. Such a player may become frustrated that he is given the "standard" pay schedule, and may depart the gaming device.

An embodiment involving a long time window may avoid to some degree the possibility of anomalous sample measurements. However, long time windows may not as readily capture sudden changes in a player's rate of play. For example, a player who plays slowly for a time but then quickly increases his rate of play may still be ascribed a slow rate of play, since the long time window will account for some of the play during the slow period. Such a player may also become frustrated, since he has started to play rapidly, but has not obtained a more favorable pay schedule.

Although the present invention has been described with respect to a preferred embodiment thereof, those skilled in the art will note that various substitutions may be made to those embodiments described herein without departing from the spirit and scope of the present invention. For example, although a slot machine-type game has been described, the present invention is likewise applicable to other types of games, such as video poker, video blackjack and video roulette.

What is claimed is:

1. A method of operating a gaming system, comprising:

for at least one wagered on play of a wagering game:

(i) causing at least one processor to execute a plurality of instructions to determine a wagering game outcome, (ii) causing at least one display device to display the determined wagering game outcome to a player, (iii) causing the at least one processor to execute the plurality of instructions to determine, based on a first paytable, any awards associated with the determined wagering game outcome, and (iv) causing the at least one display device to display any determined awards to the player;

causing the at least one processor to execute a plurality of instructions to calculate a speed of play associated with the at least one wagered on play of the wagering game;

causing the at least one processor to execute the plurality of instructions to replace the first paytable with a second different paytable based on the calculated speed of play; and for the at least one wagered on play of the wagering game:

(i) causing the at least one processor to execute the plurality of instructions to determine, based on the second, different paytable, any awards associated with the determined wagering game outcome, and (ii) causing the at least one display device to display any determined awards to the player.

2. The method of claim 1, wherein causing the at least one processor to execute the plurality of instructions to calculate the speed of play is based on at least one time interval between at least two events associated with the at least one play of the wagering game.

3. The method of claim 1, further comprising displaying to the player an indication that the probability that the player will receive a favorable outcome has increased.

4. The method of claim 2, wherein the at least two events are wagering events.

5. The method of claim 1, wherein causing the at least one processor to execute the plurality of instructions to replace the first paytable with the second different paytable includes causing the at least one processor to execute the plurality of instructions to change a nonfavorable outcome to a favorable outcome.

6. The method of claim 5, which includes causing the at least one processor to execute the plurality of instructions to change a combination of reel symbols from a nonwinning reel symbols combination to a winning reel symbols combination.

7. The method of claim 5, wherein changing a nonfavorable outcome to a favorable outcome comprises changing a reel symbol from a nonfavorable symbol for the player to a favorable symbol for the player.

8. The method of claim 1, wherein increasing a probability that a player will receive a favorable outcome comprises adding a wild reel symbol.

9. The method of claim 1, wherein increasing a probability that a player will receive a favorable outcome comprises changing a reel symbol to a wild symbol.

10. The method of claim 1, wherein increasing a probability that a player will receive a favorable outcome comprises providing additional chances for the player to receive a favorable outcome.

11. The method of claim 10, wherein additional chances for the player to receive a favorable outcome include at least one free play.

12. The method of claim 10, wherein additional chances for the player to receive a favorable outcome include allowing a player to keep at least one reel symbol for at least one additional play.

13. The method of claim 1, further including causing the at least one display device to display the speed of play to the player.

14. The method of claim 13, further including causing the at least one display device to display a speed of play required to replace the first paytable with the second different paytable.

15. The method of claim 1, further comprising displaying a rate of play required to increase a probability that the player will receive a favorable outcome.

16. The method of claim 2, wherein the at least two events occur during a single gaming session.

17. The method of claim 16, wherein causing the at least one processor to execute the plurality of instructions to replace the first paytable with the second different paytable is restricted to the single gaming session.

18. The method of claim 1, wherein the at least two events occur over a plurality of gaming sessions.

* * * * *

UNITED STATES PATENT AND TRADEMARK OFFICE

CERTIFICATE OF CORRECTION

PATENT NO. : 8,500,546 B2
APPLICATION NO. : 11/428419
DATED : August 6, 2013
INVENTOR(S) : Jay S. Walker et al.

It is certified that error appears in the above-identified patent and that said Letters Patent is hereby corrected as shown below:

IN THE CLAIMS

In Claim 1, Column 17, Line 3, replace “a” with --the--.
In Claim 2, Column 17, Line 19, between “one” and “play” insert --wagered-on--.
In Claim 3, Column 17, Line 22, replace the second instance of “the” with --a--.
In Claim 7, Column 17, Line 35, replace “a” with --the--.
In Claim 7, Column 17, Line 36, replace the first instance of “a” with --the--.
In Claim 8, Column 18, Line 1, replace “1” with --3-- and replace “a” with --the--.
In Claim 8, Column 18, Line 2, replace both instances of “a” with --the--.
In Claim 9, Column 18, Line 4, replace “1” with --3-- and replace “a” with --the--.
In Claim 9, Column 18, Line 5, replace both instances of “a” with --the--.
In Claim 10, Column 18, Line 7, replace “1” with --3-- and replace “a” with --the--.
In Claim 10, Column 18, Line 8, replace both instances of “a” with --the--.
In Claim 10, Column 18, Line 9, replace “a” with --the--.
In Claim 11, Column 18, Line 11, between “wherein” and “additional” insert --the--.
In Claim 11, Column 18, Line 12, replace “a” with --the--.
In Claim 12, Column 18, Line 14, between “wherein” and “additional” insert --the--.
In Claim 12, Column 18, Line 15, replace both instances of “a” with --the--.
In Claim 18, Column 18, Line 36, replace “1” with --2--.

Signed and Sealed this
Seventeenth Day of December, 2013

Margaret A. Focarino

Margaret A. Focarino
*Commissioner for Patents of the United States Patent and Trademark Office*

UNITED STATES PATENT AND TRADEMARK OFFICE

CERTIFICATE OF CORRECTION

PATENT NO. : 8,500,546 B2
APPLICATION NO. : 11/428419
DATED : August 6, 2013
INVENTOR(S) : Walker et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 230 days.

Signed and Sealed this
Third Day of March, 2015

Michelle K. Lee

Michelle K. Lee
*Deputy Director of the United States Patent and Trademark Office*